US008418318B2

(12) United States Patent
Scharf et al.

(10) Patent No.: US 8,418,318 B2
(45) Date of Patent: Apr. 16, 2013

(54) DRIVE CARRIAGE FOR DRIVING A SLIDABLY MOUNTED CURTAIN

(75) Inventors: Rich Scharf, Escondido, CA (US); Scot Cochran, San Diego, CA (US)

(73) Assignee: Somfy SAS, Clueses (FR)

( * ) Notice: Subject to any disclaimer, the term of this patent is extended or adjusted under 35 U.S.C. 154(b) by 0 days.

(21) Appl. No.: 13/148,441

(22) PCT Filed: Feb. 8, 2010

(86) PCT No.: PCT/FR2010/050197

§ 371 (c)(1),
(2), (4) Date: Sep. 23, 2011

(87) PCT Pub. No.: WO2010/089517

PCT Pub. Date: Aug. 12, 2010

(65) Prior Publication Data

US 2012/0011681 A1 Jan. 19, 2012

(30) Foreign Application Priority Data

Feb. 9, 2009 (FR) ..... 09 50794

(51) Int. Cl.
*E05D 15/06* (2006.01)

(52) U.S. Cl.
USPC ..... 16/106; 16/91; 16/97; 16/107

(58) Field of Classification Search ..... 16/90, 91, 16/94 R, 96 R, 95 R, 97, 101–107, 87 R, 16/84 R, 87.6 R, 87.8, 273; 160/185, 199; 49/404, 409, 410, 411, 412, 420, 421–425, 49/453, 455

See application file for complete search history.

(56) References Cited

U.S. PATENT DOCUMENTS

| | | | | | |
|---|---|---|---|---|---|
| 885,970 | A | * | 4/1908 | Barr | 16/105 |
| 1,689,665 | A | * | 10/1928 | Cramp | 16/103 |
| 1,792,568 | A | * | 2/1931 | Boedtcher | 16/106 |
| 2,618,808 | A | * | 11/1952 | Spence et al. | 16/105 |
| 2,819,498 | A | * | 1/1958 | Grossman | 49/130 |
| 2,940,112 | A | * | 6/1960 | Riser | 16/105 |
| 3,049,083 | A | * | 8/1962 | Potter et al. | 105/156 |
| 3,203,028 | A | * | 8/1965 | Knape | 16/105 |
| 3,345,676 | A | | 10/1967 | Graber et al. | |
| 3,580,183 | A | * | 5/1971 | Nearman | 104/111 |
| 3,996,643 | A | * | 12/1976 | Steigerwald | 16/99 |
| 4,519,433 | A | | 5/1985 | Comeau | |
| 5,542,149 | A | * | 8/1996 | Yu | 16/87.4 R |
| 5,950,279 | A | * | 9/1999 | Chaput | 16/105 |
| 6,098,695 | A | * | 8/2000 | Schwingle | 160/199 |
| 6,141,827 | A | * | 11/2000 | Wu | 16/91 |

(Continued)

FOREIGN PATENT DOCUMENTS

| | | | |
|---|---|---|---|
| GB | 508353 | A | 6/1939 |
| GB | 735305 | A | 8/1955 |
| JP | 04079916 | A | 3/1992 |

*Primary Examiner* — Chuck Y. Mah
(74) *Attorney, Agent, or Firm* — Dowell & Dowell, PC

(57) ABSTRACT

A drive carriage for a sliding curtain including a first carriage portion which is movable along a rail by at least one wheel assembly mounted thereto and a second carriage portion which is also movable along the rail and wherein the first and second portions of the carriage are connected by a coupling piece which is selective mounted in at least two positions with respect to the first and second portions so as to adjust a length of the drive carriage.

12 Claims, 5 Drawing Sheets

U.S. PATENT DOCUMENTS

2002/0170234 A1* 11/2002 Salice ..... 49/453
2004/0173117 A1* 9/2004 Galpin et al. ..... 105/148
2007/0101540 A1* 5/2007 Martin ..... 16/97
2008/0289778 A1* 11/2008 Vrielink ..... 160/331

* cited by examiner

DRIVE CARRIAGE FOR DRIVING A SLIDABLY MOUNTED CURTAIN

BACKGROUND OF THE INVENTION

1. Field of the Invention.

The invention relates to the field of installations for providing closure or screening against the sun, and in particular to the field of slidably mounted curtains. Such curtains are generally fastened to a set of runners mounted to move along a rail, each of which runners is mounted on a pair of carrier wheels and is provided with a fastening element for fastening to the curtain. A carriage is driven along the rail via a belt or via a cord under the action of manual operation, or under the action of an electro-mechanical actuator. The carriage moving causes the various runners to move, either via the curtain itself, or via cords connecting the first runner to the carriage and each runner to the next runner. When the curtains are in a plurality of panels closing towards each other, each panel of curtain is driven by a carriage. The carriage also makes it possible to form a coupling between the two ends of the belt, which belt thus forms an endless drive element between two drive pulleys.

2. Brief Description of the Related Art

Motor-driven curtains are in common use in hotel rooms or in conference centers, i.e. in places very often designed by architects seeking to achieve aesthetically pleasing appearance. In particular, the curtains are mounted across openings that themselves are not plane and/or that follow curves for reasons of making the place look aesthetically pleasing.

The problems involved in providing carriages for curtains that are to follow curved rails have been known for a long time. In particular, document GB-A-735 305 describes a hinged carriage that is adapted to travel around the curves in the rail. That carriage is made of a flexible strip on which plates equipped with vertical and horizontal wheels are mounted. That carriage is thus capable of rolling along a V-shaped rail on a plurality of wheels, while also accommodating distortions in a plane perpendicular to its longitudinal axis, for traveling around the curves in the rail. In addition, that curtain is mounted on simple runners with a single pair of wheels on a common axis perpendicular to the rail for each runner.

Alternatively to being mounted on a flexible strip, the various subassemblies of the carriage may be articulated via hinges. Document GB-A-735 305 does not give any additional details on that construction.

Document JP-A-04 079916 describes a motor-drive system of the linear type in which a curtain drive carriage is also made up of a plurality of subassemblies articulated via hinges.

Such hinged carriages are particularly advantageous for use on curved rails. Unfortunately, they can lack rigidity for traveling along rectilinear portions of the rail, which can cause considerable amounts of friction if the carriage folds or twists when such folding or twisting is not necessary. In addition, the state of the art does not make any provision to adapt the carriage as a function of the configuration of the rail or of the length and of the tension of its drive belt.

SUMMARY OF THE INVENTION

The invention thus proposes to remedy the above-mentioned drawbacks, and to provide a carriage structure satisfying the desired technical and modularity needs in the field of driving slidably mounted curtains.

The carriage of the invention comprises a first carriage portion or "front carriage", and a second carriage portion or "back carriage", the two carriage portions being mounted to move along a rail by means of carrier wheels and being coupled together by a hinge piece. This carriage is characterized in that the carriage further comprises means for mounting the hinge piece in at least two positions relative to one of the first and second portions of the carriage.

By means of the invention, the distance between the carriage portions may be adjusted, in particular as a function of the length of the drive belt of the carriage, thereby making it possible, in particular, to adjust the tension of said belt. Thus, the total length of the carriage is variable as a function of its mounting environment and the various component parts of the carriage can be mounted at variable distances from one another.

In addition, a rigid body of the first portion of the carriage transmits the drive forces without giving rise to any misalignment relative to the rail, and the components of the carriage being hinge-mounted makes it possible for them to travel around curves in the rail.

Advantageously, first hinge means for hinging the carriage comprise a support for supporting at least one of the carrier wheels of the front carriage, which support is mounted to pivot, relative to the carriage, about an axis perpendicular to the axis of rotation of the wheel.

Preferably, at least one carriage portion is provided with at least a second wheel that turns about an axis that is fixed relative to the rigid body, and that keeps the carriage stable relative to the rail. This stability is all the more important that, on the carriage portion, one or more fastening prongs are provided for fastening to the curtain, the prongs being cantilevered out relative to the front carriage. Said fastening prong(s) serve(s) to fasten one edge of the curtain to the front of the carriage, so as to overlap the other curtain edge without any daylight between them when two curtain panels close towards each other.

Advantageously, the carriage is made up of two portions mounted to move relative to each other in a direction perpendicular to the direction of movement of the carriage, in such a manner as to accommodate the curvature of the guide rail.

The combination of the first pivot for mounting the wheel and of the hinged coupling between the two moving portions makes it possible to travel around curved rail portions, including when the radius of curvature is small.

In other advantageous but non-essential aspects of the invention, a drive carriage may incorporate one or more of the following characteristics taken in any technically feasible combination:

- The carriage further comprises adjustment means for adjusting the mounting of the hinge piece for the various mounting positions.
- The hinge piece is rigid and mounted with at least one degree of freedom on at least one of the portions of the carriage.
- The hinge piece is mounted without any degree of freedom on one of or on both of the carriage portions.
- The hinge piece has a first folded-over end forming a hinge with the first carriage portion.
- The hinge piece has at least a second folded-over end enabling it to be mounted on the second carriage portion.
- The second carriage portion is provided with a plurality of recesses for receiving the second folded-over end of the piece.
- The hinge piece is mounted without any degree of freedom on one of or on both of the first and second portions of the carriage.

The carriage comprises two distinct hinge means of different types, for hinging components of the carriage relative to a rigid body of the first portion of the carriage. In which case, provision may be made for first hinge means of the carriage to comprise a support for supporting at least one of the carrier wheels of the first carriage portion, which support is mounted to pivot relative to the carriage, about an axis that is perpendicular to the axis of rotation of said wheel.

The first carriage portion carries two pairs of carrier wheels and two pairs of stabilizer wheels.

The carriage further comprises means for fastening the ends of a flexible drive link for driving the carriage respectively to the first and second portions of the carriage. The drive belt, mounted via each of its ends on different parts of the carriage, can thus be tensioned or relaxed as a function of its length and of the tension required by the installation. As a result, a single embodiment of the carriage solves two problems: the problem of traveling around the curves in the guide rail and the problem of tension of the drive element such as a belt.

The hinge axes of the two hinge means are parallel and are separated by a distance less than the distance between the two carriage portions.

In addition, the carriage of the invention makes it possible to solve two constraints: providing a hinge for the carriage combined with rigid and strong fastening of the two ends of the belt.

It is very simple to assemble the various parts of the carriage, and such assembly does not require fragile pieces for linking the various parts together. The various parts of the carriage can be assembled on site, thereby making it possible to configure the carriage for a right curve or for a left curve of the rail. In particular, assembling the belt to at least one of the parts of the carriage can be performed unstressed and outside the rail, the belt being tensioned merely when the coupling piece is mounted.

At least a first carriage portion is mounted on a plurality of pairs of wheels, thereby ensuring that the carriage portion is kept stable, independently of the other parts forming the carriage, i.e. of the second carriage portion and of the hinge means. This stability is ensured in the longitudinal direction of movement of the carriage, and in the perpendicular direction, along the axes of the wheels, due to the presence of a pair of wheels, each wheel in the pair being disposed on a respective side of the longitudinal axis of the carriage.

Advantageously, a particular embodiment of the coupling piece or a particular implementation of the way in which it is mounted relative to the parts of the carriage also makes it possible to compensate for variations in height along the rail, i.e. makes it possible to enable the carriage to move in a plane perpendicular to the hinge.

BRIEF DESCRIPTION OF THE DRAWINGS

The invention can be better understood and other advantages of the invention appear more clearly from the following description of two embodiments of a drive carriage and of an installation that comply with the principle of the invention, the description being given merely by way of example and with reference to the accompanying drawings, in which.

In addition to FIGS. 1-7.

DESCRIPTION OF THE PREFERRED EMBODIMENTS

Figure 2:
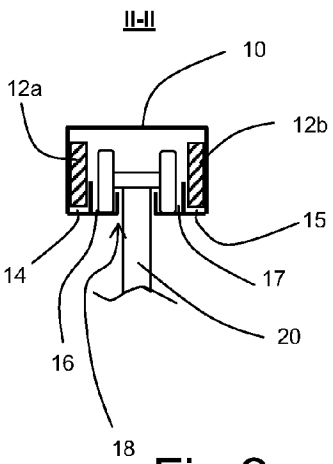
FIG. 2 is a fragmentary section view on line II-II of FIG. 1.
Figure 1:
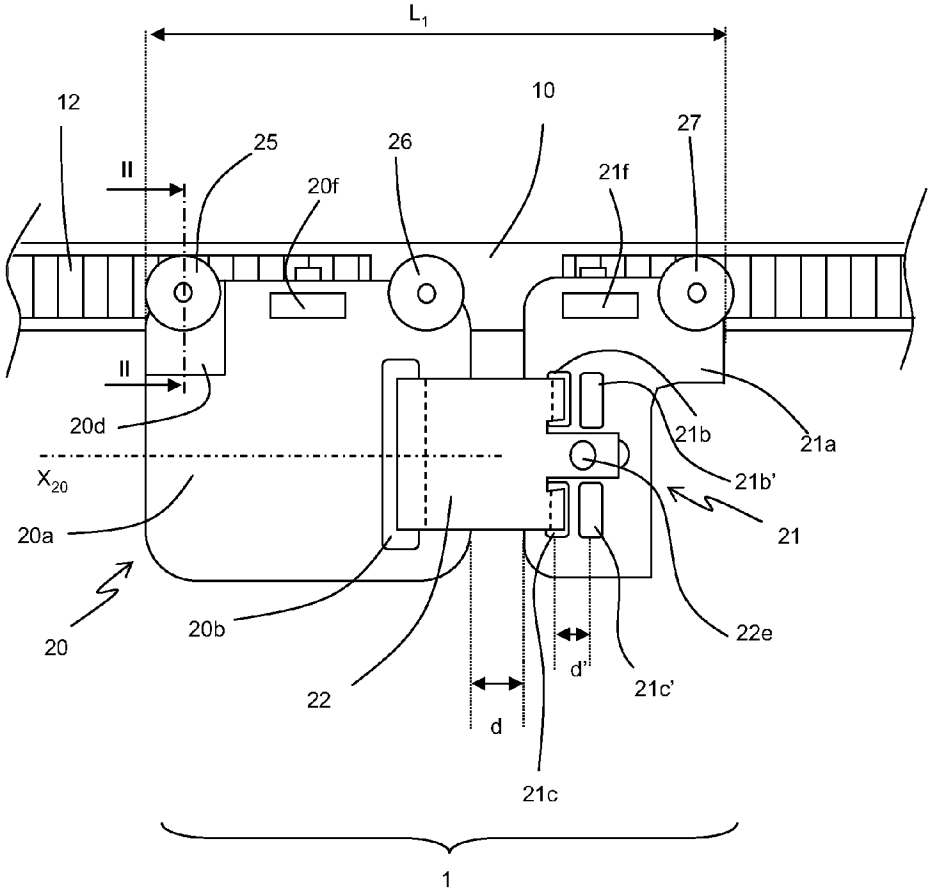
FIG. 1 is a fragmentary diagrammatic view of a sliding-curtain screening installation including a drive carriage of the invention.

FIG. 1 is a fragmentary diagrammatic view of a bay-screening installation that comprises a curtain (not shown) driven by a drive carriage 1 secured to two ends of a belt 12, itself driven by a pulley (not shown) moved by an actuator (not shown either), such as an electric motor. A rail 10 guides the carriage 1 during the opening and closure movements of the curtain R. As appears from FIG. 2, the rail 10 has a substantially rectangular cross-section forming, on its bottom surface, guides 14 and 15 for the belt 12 as looped onto itself, and guides 16 and 17 for wheels of the carriage, and a longitudinal opening 18 through which the body of the carriage itself can pass.

The carriage is made up of two portions 20 and 21, respectively a front portion and a back portion, assembled together via a coupling piece 22. In the present description, the concepts of "front" and of "back" are conventions corresponding to the movement of the carriage 1 from right to left in FIG. 1, it being recalled that the carriage can also move in the opposite direction along the rail 10.

A "front" first portion 20 of the carriage 1 rolls in the rail by means of two pairs of carrier wheels 25 and 26. The first pair of wheels 25 is mounted to pivot relative to the body 20*a* of the front carriage 20 about an axis $Z_{20}$ that is perpendicular to a longitudinal axis $X_{20}$ of the front carriage 20 taken in the direction of advance of the front carriage 20 along the rail 10. The axis $Z_{20}$ is substantially vertical when the carriage 1 is supported by the rail 10, which is horizontal. Alternatively, it is the second pair of wheels 26 that is mounted to pivot about an axis parallel to the axis $Z_{20}$. The pivotally mounted pair of wheels is mounted on a support 20*d*, with the wheels being mounted to rotate about an axis $Y_{20}$ perpendicular to the axis $Z_{20}$. The support 20*d* is itself mounted on the body 20*a* to pivot about the axis $Z_{20}$. The angle at which the axis $Y_{20}$ extends relative to the axis $X_{20}$ is thus variable. The pivotally mounted first pair of wheels can thus pivot about the axis $Z_{20}$, as indicated by the double-headed arrow $F_1$ in FIG. 3, and can thus make it possible for the carriage to travel along curved rails. This remains applicable (ignoring the axis references) when the second pair of wheels is mounted to pivot.

The body 20*a* of the front carriage 20 is rigid.

Figure 6:
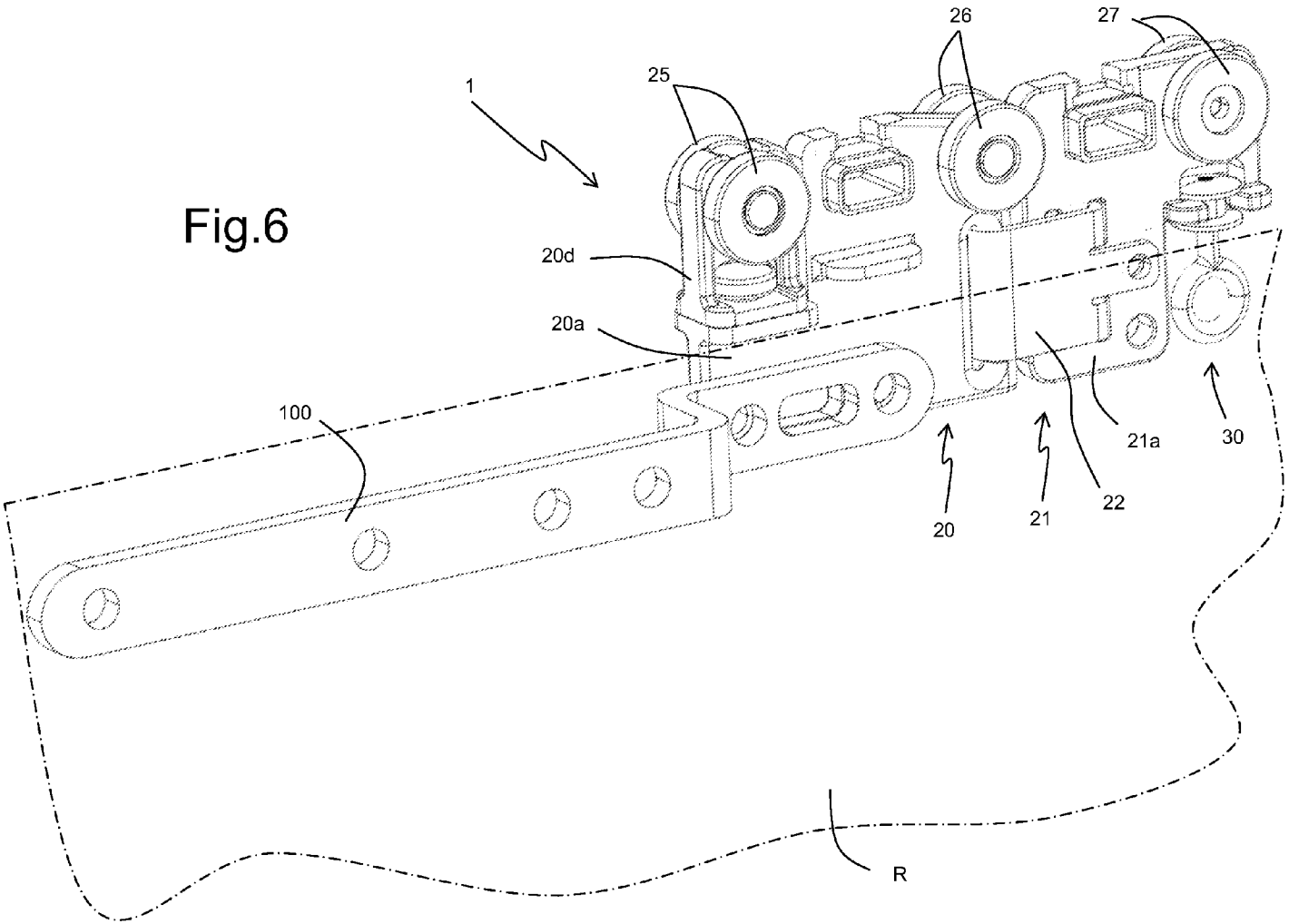
FIG. 6 is a perspective view analogous to FIG. 3, when the carriage is in a second configuration of use.

The second pair of wheels 26 of the front carriage 20 makes it possible, in combination with the first pair of wheels 25, to ensure stability for the front carriage in the rail 10. As shown in FIG. 6, the front carriage may be connected to a prong 100 for fastening to the curtain, which prong extends cantilevered out relative to the body of the front carriage. In FIG. 6, the outline of the curtain is visible and is referenced R. The tipping torque exerted on the carriage portion 20 can be large, particularly when the weight of the curtain R fastened to said fastening prong is added. The wheels of the second pair of wheels can then find themselves in contact with the top edge of the rail.

The wheels of the second pair of wheels 26 are mounted to turn about an axis $Y'_{20}$ that is perpendicular to the axes $X_{20}$ and $Z_{20}$, and that is fixed relative to the body 20*a*.

The front carriage 20 is coupled to the second carriage portion 21 or "back carriage" via the coupling piece 22. The coupling piece 22 is in the form of a rigid piece mounted firstly on the front carriage 20, in a notch 20*b* provided for this purpose, and secondly on the back carriage 21, in at least one notch 21*b*.

The body 21*a* of the back carriage 21 is rigid, and its wheels 27 are mounted to turn about an axis $Y_{21}$ that is fixed relative to said body.

The bodies 20*a* and 21*a* of the front and back carriages may be made of metal or of rigid plastics material.

Figure 3:
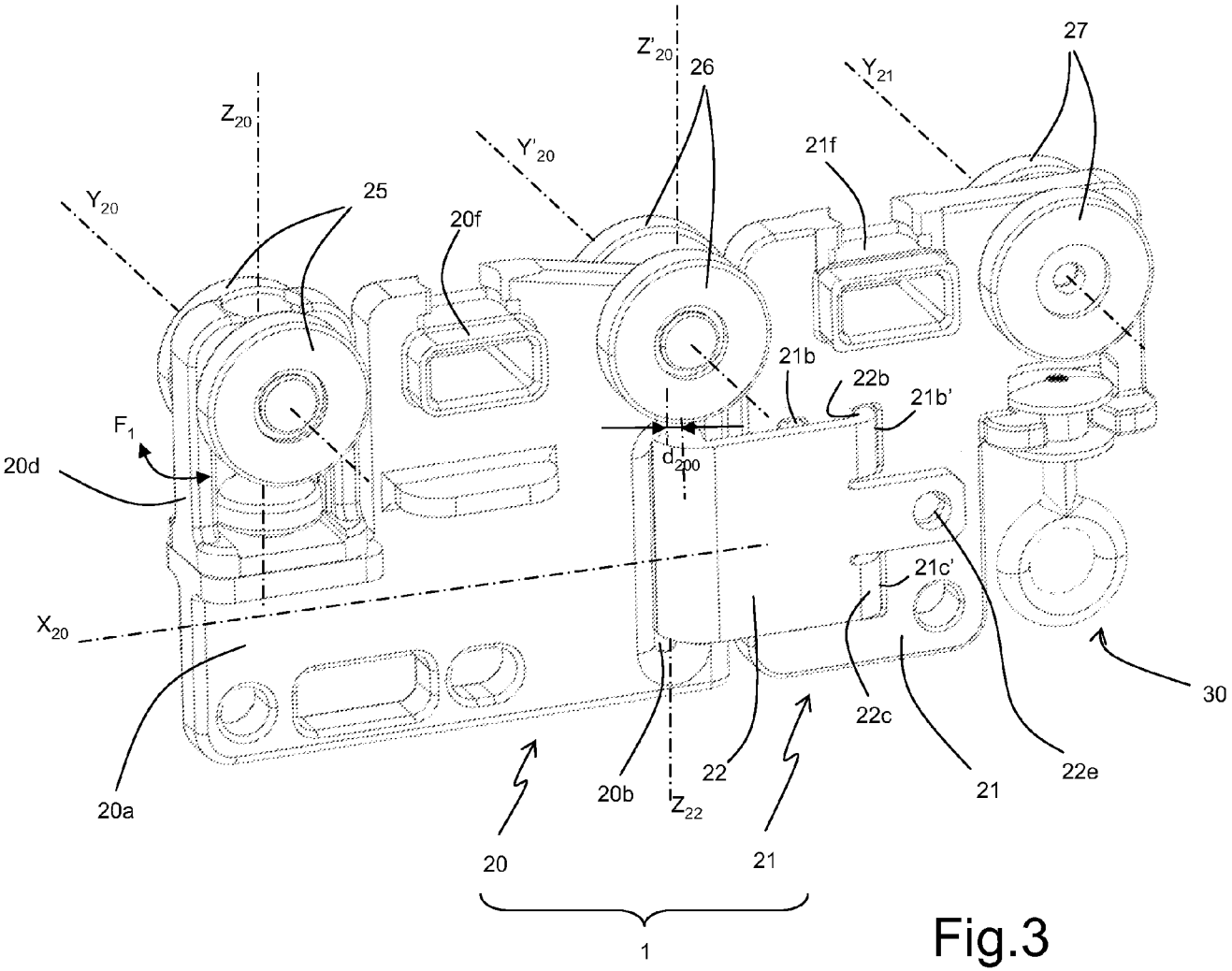
FIG. 3 is a perspective view of the drive carriage of the installation of FIG. 1.

FIG. 3 is a perspective view of the above-described component parts of the drive carriage 1. The pairs of wheels 25, 26, and 27 are visible.

Figure 4:
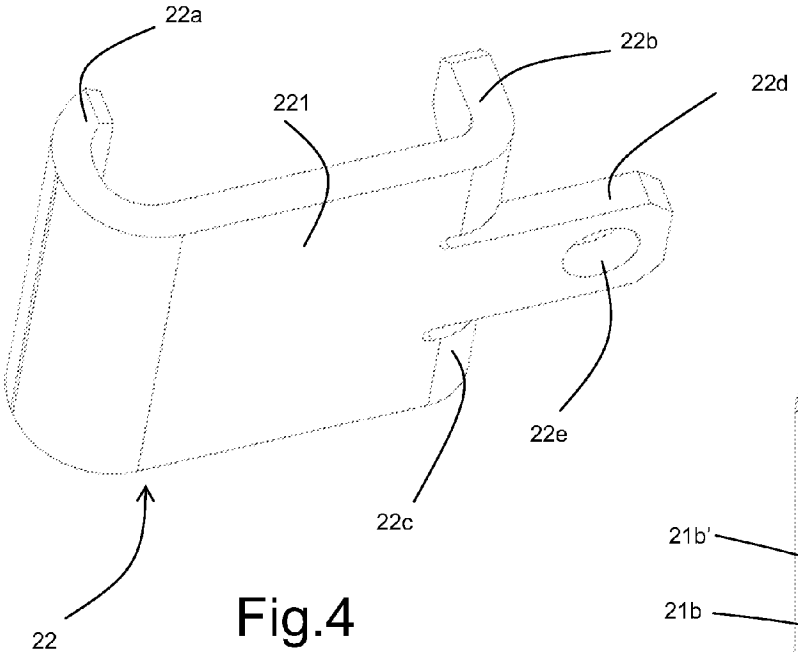
FIG. 4 is a perspective view on a larger scale and from another angle of a coupling piece that is part of the FIG. 3 carriage.

FIG. 4 is a side view of the coupling piece as isolated from the remainder of the carriage 1. This coupling piece is made of metal or of rigid plastics material. It has a plane main web 221, from which a first end 22*a* of the piece 22 extends that is folded over and rounded. This end 22*a* being inserted into the notch 20*b* of the front carriage forms a hinge between the coupling piece 22 and the front carriage 20. In other words, by means of this hinging, the piece 22 can pivot relative to the body 20*a* about an axis $Z_{22}$ parallel to the axis $Z_{20}$.

The axes $Z_{20}$ and $Z_{22}$ thus constitute two mutually parallel hinge axes. These axes are perpendicular to the axes of rotation of the wheels 25 and 26 and to a longitudinal axis of the carriage that coincides with the axis $X_{20}$ when the portions 20 and 21 are in alignment. The components of the carriage 1 that are, firstly, the pair of wheels 25, and secondly the back carriage 21 are hinged via the means 20*d* and 22 to the body 20 of the front carriage.

At the other end of the web 221 of the coupling piece 22, two tines 22*b* and 22*c* are provided that are folded back at right angles relative to the web 221, in such manner as to be able to penetrate into corresponding notches 21*b* and 21*c* in the back carriage 21. A central and rectilinear intermediate tine 22*d* extends in alignment with the web 221, between the tines 22*b* and 22*c*. Said intermediate tine is provided with a hole 22*e*. During assembly, said intermediate tine extends along the body 21*a* of the back carriage 21 and can be fastened, e.g. by a screw passing through the hole 22*e* and engaged in a corresponding tapped hole 21*d* in the back carriage 21. When it couples together the front and back carriages 20 and 21, the piece 22 forms hinge means between these portions of the carriage 1, insofar as the end 22*a* is hinged in the notch 20*b*.

In the configuration shown in FIG. 1, the first portion 20 and the second portion 21 of the carriage are spaced apart from each other by a distance d set by the coupling piece 22. In this configuration, the tines 22*b* and 22*c* are engaged in the notches 21*b* and 21*c*.

If the tines 22*b* and 22*c* of the coupling piece 22 are inserted into second notches 21*b*' and 21*c*' provided in the body 21*a*, as shown in FIG. 3, the distance between the carriage portions 20 and 21 is reduced to a distance d' that corresponds to the distance between the centers of the notches 21*b* and 21*b*'.

A second tapped hole 21*d*' is provided, at the distance d' from the tapped hole 21*d* for the purpose of receiving a screw passing through the hole 22*e* when the tines 22*b* and 22*c* are engaged in the notches 21*b*' and 21*c*'.

This two-position mounting of the coupling piece 22 on the back carriage 21 makes it possible to adjust the total length $L_1$ of the rectilinear carriage parallel to the direction of the rail 10, and, in particular, to adjust the distance between the fastening points at which the ends of the belt 12 are fastened to each carriage portion 20 or 21.

Thus, it is possible to adjust the drive carriage to fit the length of the belt 12 or to adjust the tension of said belt. Other adjustment means could be provided in order to make it possible to adjust the distances d and d' more finely, e.g. by using systems of sets of teeth on one or other of the coupled-together parts 20, 21, and 22. Alternatively, or additionally, the adjustment could be achieved via a screw held stationary in an oblong hole.

Since the back carriage 21 is connected to the front carriage 20 via the coupling piece 22, the back carriage 21 needs only a single pair of wheels 27. However, it could be equipped with two pairs of wheels, optionally including a pivotally mounted pair of wheels, like the front carriage. The use of two pairs of wheels on at least one of the portions 20 or 21 of the carriage 1 makes it possible to guarantee maximum stability, regardless of the driven load, and thus to minimize friction, in particular when the weight of the curtain is large. The use of non-rigid wheels, e.g. made or plastic or covered with rubber, for example, makes it possible to minimize the noise of the rolling on the rail 10.

The back carriage 21 carries an eyelet 30 for supporting the curtain. Said eyelet 30 makes it possible to fasten a portion of the curtain to the carriage 1 for the purpose of driving it along the rail 10. The eyelet may, in known manner, be mounted removably on the rear carriage 21. Various other types of support could be connected to the carriage 1 in place of the eyelet, e.g. a hook, a ring, or any other fastening means adapted to finishing the curtain.

In a variant (not shown) of the invention, the coupling piece 22 itself may incorporate another degree of freedom in the coupling with or between the portions 20 and 21 of the carriage. This additional degree of freedom can make it possible to compensate for variations in the height of the rail and/or can add to the flexibility of the carriage so as to adjust to accommodate the curves of the rail (e.g. by inserting a hinge at the level of the coupling piece itself), in particular for curves of small radius.

This additional degree of freedom may be present solely at the level of one of the fastening zones for fastening the coupling piece 22 to one of the portions 20 and 21 of the carriage. For example, provision may be made for the notch 20*b* to extend further, e.g. in the height direction, i.e. parallel to the axis $Z_{20}$, than is necessary for receiving the folded-over end 22*a* of the coupling piece 22. Thus, the coupling piece 22 can move by sliding to a small extent in the height direction relative to the front carriage 20, or vice versa.

In another variant (not shown) of the invention, the piece 22 may be mounted with a degree of freedom relative to each of the portions 20 and 21 of the carriage 1.

Figure 5:
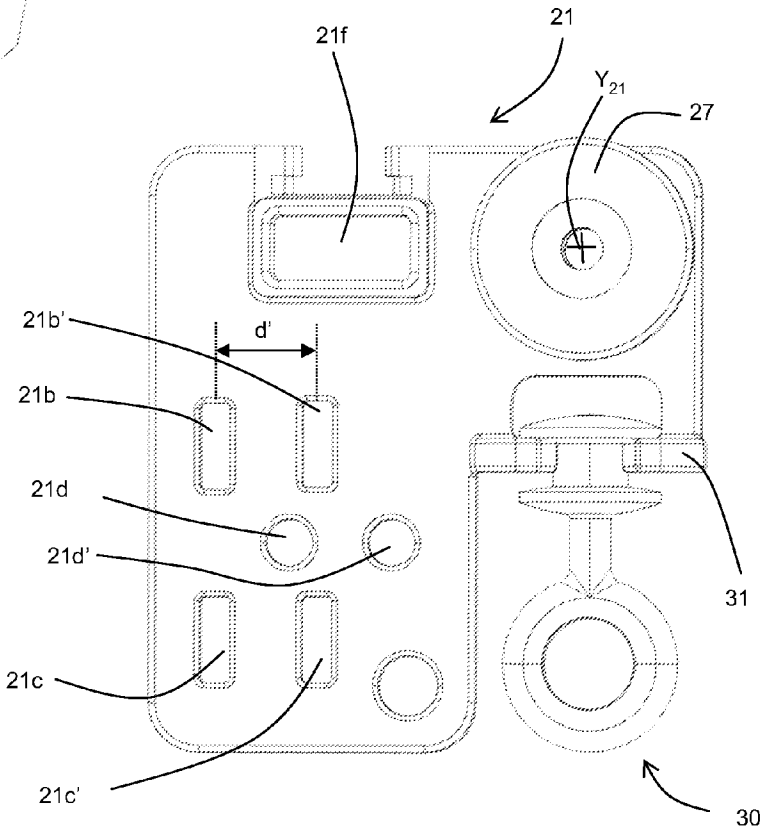
FIG. 5 is a side view of a portion of the FIG. 3 carriage.

FIG. 5 shows the back carriage on its own. The following elements are to be found again in this figure:

the first pair of notches 21*b*, 21*c*, designed to receive the folded-over tines 22*b* and 22*c* of the coupling piece 22 in the first mounting position shown in FIG. 1, and the second pair of notches 21*b*' and 21*c*' used for receiving the tines 22*b* and 22*c* in the second position shown in FIG. 3, thereby making it possible to adjust the distance between the front carriage 20 and the back carriage 21.

In another variant (not shown) of the invention, more than two sets of notches can be provided, thereby making it possible to use three or more than three positions for mounting the piece 22 on the front carriage 21.

Instead of each pair of notches, a single notch could be provided if, in corresponding manner, the coupling piece 22 has only a single folded-over tine, e.g. a central folded-over tine. The two tapped holes 21*d* and 21*d*' serve for fastening the coupling piece 22 on the back carriage 21 by means of a screw, in the two configurations provided by the sets of notches. In a variant, these tapped holes are replaced by smooth holes and the screw passes through the body 21*a* of the carriage 21 from one side to the other so as to co-operate with a nut mounted against the face of the body 21*a* that is opposite from the face visible in FIG. 5.

Provision may also be made for the pairs of notches 21*b* and 21*c* or 21*b*' and 21*c*' to be wider, parallel to the length of the carriage 1, than is necessary for receiving the tines 22*b* and 22*c*, and the hole 22*e* in the central tine may be brought into register with an oblong hole in the back carriage 21. Thus, fine adjustment of the position is possible for each mounting position.

FIG. 5 also shows fastening means 21*f* for fastening to one end of the belt 12. These fastening means 21*f* are not described in detail but they may co-operate with an intermediate piece holding one end of the belt 12 at the level of the back carriage, in a manner known per se. Corresponding fastening means 20*f* are also provided on the front carriage 20 for fastening the other end of the belt 12 thereto.

The invention is shown with a single pair of pivotally mounted wheels 25. In a variant, one or more other pairs of wheels may pivot about axes parallel to the axis $Z_{20}$.

In a variant (not shown) of the invention, the wheels 26 are mounted to pivot about an axis $Z'_{20}$ parallel to the axis $Z_{20}$ defined above. A support of the same type as the support 20*d* may be used. In which case, the distance $d_{200}$ between the hinge axes $Z'_{20}$ and $Z_{22}$ is less than the distance d between the front portion and the back portion of the carriage. A support of the same type as the support 20*d* may be used.

As appears from the above, the two hinge means of different types are a pivotally mounted wheel support, and a hinge piece forming a coupling between two carriage portions.

Figure 7:
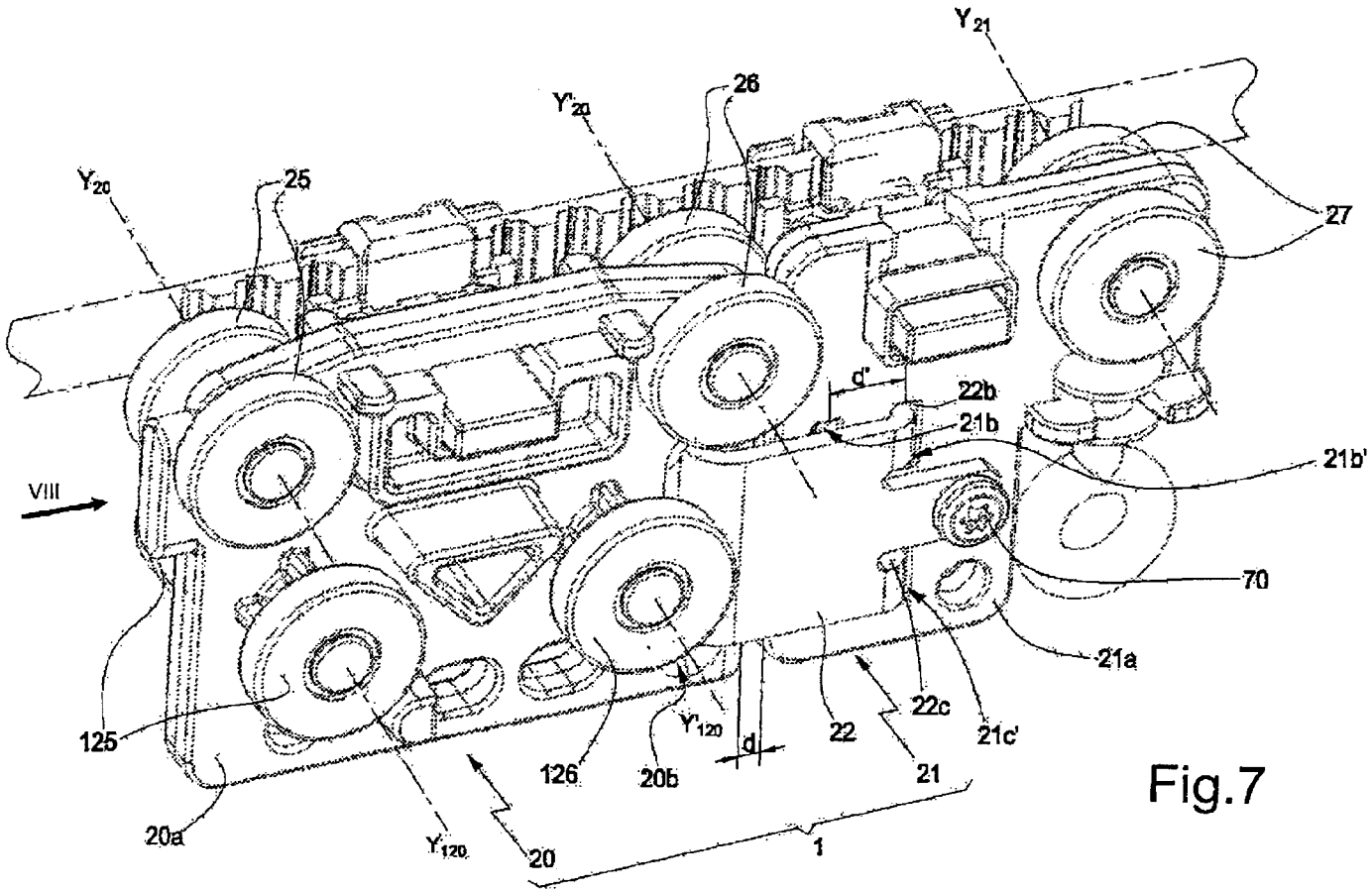
FIG. 7 is a perspective view showing a second embodiment of a carriage of the invention and a portion of its drive belt.

In the second embodiment of the invention that is shown in FIG. 7, elements analogous to elements of the first embodiment bear like references.

The carriage 1 of this second embodiment is made up of a first portion or "front carriage" 20 and of a second portion or "back carriage" 21. A coupling piece 22 is used to couple together the portions 20 and 21. This coupling piece 22 is identical to the piece shown in FIG. 4 and it is in the form of a rigid piece having its first end (not shown in FIG. 7 but identical to the end referenced 22*a* in FIG. 4) engaged in a notch 20*b* in the body 20*a* of the first portion 20 of the carriage. The coupling piece 22 being partially inserted in the notch 20*b* in this way forms a hinge between the parts 22 and 20*a*. In addition, the piece 22 is provided with two tines 22*b* and 22*c* that can selectively be engaged in two series of notches provided in the body 21*a* of the portion 21. In FIG. 7, two notches 21*b*' and 21*c*' are visible, in which notches the tines 22*b* and 22*c* are engaged, while another notch 21*b* is visible, at a distance d' from the notch 21*b*'.

The pairs of notches 21*b* and equivalent, 21*b*' and 21*c*' make it possible to mount the tine 22 in two positions relative to the body 21*a*, thereby making it possible to adjust the distance d between the bodies 20*a* and 21*a* of the portions 20 and 21.

The portion 21 of this embodiment is identical to the portion of the first embodiment and corresponds to what is shown in FIG. 5.

The portion 20 differs from the portion of the first embodiment in that all of the carrier wheels 25 and 26 are mounted with their respective hinge axes $Y_{20}$ and $Y'_{20}$ fixed relative to the front carriage portion 20. In addition, carrier wheels 27 are mounted to pivot about an axis $Y_{21}$ that is fixed relative to the back carriage portion 21. The portions 20 and 21 are rigid, as in the first embodiment.

Figure 8:
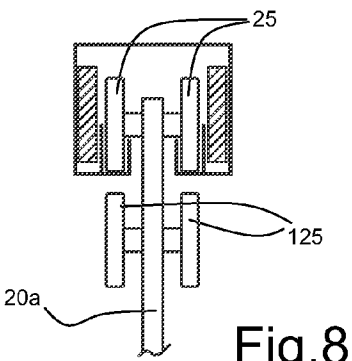
FIG. 8 is a cross sectional illustration view taken along arrow VIII on FIG. 7 of the upper and lower wheels relative to the first carriage portion in accordance with an alternate embodiment of the invention.

In addition, the body 20*a* carries two series of two wheels 125 and 126, only the wheels 125 and 126 that are situated on one side of the body 20*a* being visible in full in FIG. 7, it being specified that an analogous wheel is mounted on the side of the body 20*a* that is not visible in FIG. 7. The wheels 125 and 126 are mounted to turn about axes $Y_{120}$ and $Y'_{120}$ that are parallel to the axes $Y_{20}$ and $Y'_{20}$ and that extend at an angle that is unvarying relative to the body 20*a*. These wheels 125 and 126 serve to stabilize the carriage in the rail when a heavy curtain is mounted on a fastening prong extending cantilevered out relative to the carriage, like the prong shown in FIG. 6, with reference 100, for the first embodiment. If the carriage tips due to the prong being cantilevered out, the wheels 125 and 126 make it possible to keep the carriage in alignment and to prevent the non-pivoting elements of the carriage from rubbing against a portion of the rail, see FIG. 8 which is a view taken along arrow VIII of FIG. 7.

The characteristics of the various embodiments and variants considered above may be combined within the ambit of the present invention.

The invention claimed is:

1. A drive carriage for driving a slidably mounted curtain, which carriage comprises a first carriage portion and a second carriage portion coupled together by a coupling piece thereby forming a hinge therebetween, carrier wheels mounted on the first and second carriage portions for supporting the first and second carriage portions on a guide rail, and the coupling piece being mountable in at least two positions relative to one of the first and second carriage portions of the drive carriage so as to selectively adjust a length of the drive carriage.

2. The drive carriage according to claim 1, including adjustment means for adjusting the mounting of the coupling piece for the at least two positions.

3. The drive carriage according to claim 1, wherein the coupling piece is rigid and mounted with at least one degree of freedom on at least one of the first and second portions of the carriage.

4. The drive carriage according to claim 1, wherein the coupling piece has a first folded-over end engaging the first carriage portion and forming a hinge about a pivot axis $Z_{22}$ with the first carriage portion.

5. The drive carriage according to claim 4, wherein the coupling piece has at least one second folded-over end portion opposite the first folded-over end portion, the at least one second folded-over end portion enabling the coupling piece to be mounted to the second carriage portion.

6. The drive carriage according to claim 5, wherein the second carriage portion is provided with a plurality of recesses for receiving the second folded-over end portion of the coupling piece therein.

7. The drive carriage according to claim 6, wherein the coupling piece has at least two second folded-over end portions and the second portion of the carriage includes at least two horizontally spaced recesses for each of the two second folded-over end portions.

8. The drive carriage according to claim 7, wherein the coupling piece includes a planar web from which the first and second folded-over portions extend, a tine extending from and generally co-planar to the web along an outer surface of the second carriage portion of the carriage adjacent the at least two second folded-over end portions, and fastening means for securing the tine to the second carriage portion.

9. The drive carriage according to claim 8, wherein the wheels for supporting the first carriage portion include at least one set of wheels mounted on a wheel support which is mounted to pivot, relative to the first carriage portion, about an axis perpendicular to an axis of rotation of the set of wheels.

10. The drive carriage according to claim 1, wherein the first carriage portion carries two upper pairs of carrier wheels for supporting the first carriage portion on the guide rail and two pairs of stabilizer wheels spaced below the upper pairs of carrier wheels.

11. The drive carriage according to claim 1, including fastening means for fastening ends of a flexible drive link for driving the carriage respectively to the first and second portions of the carriage.

12. The drive carriage according to claim 4, wherein the wheels for supporting the first carriage portion include a set of wheels which pivot about an axis $Z'_{20}$ parallel to the pivot axis $Z_{22}$ between the coupling piece and the first carriage portion, and wherein the axes $Z'_{20}$ and $Z_{22}$ are parallel and are separated by a distance less than a distance between the first and second carriage portions.

* * * * *